US007861256B2

(12) United States Patent
Kano

(10) Patent No.: US 7,861,256 B2
(45) Date of Patent: Dec. 28, 2010

(54) BROADCAST RECEIVER AND METHOD AND APPARATUS FOR COMPUTING VIEWING/LISTENING INFORMATION

(75) Inventor: Tsuyoshi Kano, Tokyo (JP)

(73) Assignee: Sony Corporation (JP)

( * ) Notice: Subject to any disclaimer, the term of this patent is extended or adjusted under 35 U.S.C. 154(b) by 1170 days.

(21) Appl. No.: 10/010,877

(22) Filed: Nov. 8, 2001

(65) Prior Publication Data

US 2002/0078469 A1 Jun. 20, 2002

(30) Foreign Application Priority Data

Nov. 16, 2000 (JP) ..... P2000-349674

(51) Int. Cl.
*H04H 60/33* (2008.01)

(52) U.S. Cl. ..... 725/9; 725/131; 725/151

(58) Field of Classification Search ..... 725/9, 725/14, 131, 151

See application file for complete search history.

(56) References Cited

U.S. PATENT DOCUMENTS

| | | | | |
|---|---|---|---|---|
| 5,374,951 | A | 12/1994 | Welsh et al. | |
| 5,801,747 | A * | 9/1998 | Bedard | 725/46 |
| 5,850,249 | A | 12/1998 | Massetti et al. | |
| 5,872,588 | A * | 2/1999 | Aras et al. | 725/14 |
| 5,977,964 | A * | 11/1999 | Williams et al. | 715/721 |
| 6,286,140 | B1 * | 9/2001 | Ivanyi | 725/14 |
| 6,438,751 | B1 * | 8/2002 | Voyticky et al. | 725/42 |
| 6,438,752 | B1 * | 8/2002 | McClard | 725/46 |
| 6,446,261 | B1 * | 9/2002 | Rosser | 725/34 |
| 6,530,082 | B1 * | 3/2003 | Del Sesto et al. | 725/9 |
| 6,604,239 | B1 * | 8/2003 | Kohen | 705/36 R |
| 6,637,028 | B1 * | 10/2003 | Voyticky et al. | 725/42 |
| 6,637,029 | B1 * | 10/2003 | Maissel et al. | 725/46 |
| 6,704,929 | B1 * | 3/2004 | Ozer et al. | 725/13 |
| 6,708,335 | B1 * | 3/2004 | Ozer et al. | 725/20 |
| 6,961,954 | B1 * | 11/2005 | Maybury et al. | 725/53 |
| 7,197,758 | B1 * | 3/2007 | Blackketter et al. | 725/37 |
| 7,200,852 | B1 * | 4/2007 | Block | 725/28 |
| 7,284,064 | B1 * | 10/2007 | Connelly | 709/231 |
| 2002/0059577 | A1 * | 5/2002 | Lu et al. | 725/9 |
| 2004/0049787 | A1 * | 3/2004 | Maissel et al. | 725/46 |
| 2005/0091685 | A1 * | 4/2005 | Sezan et al. | 725/46 |

FOREIGN PATENT DOCUMENTS

| | | |
|---|---|---|
| FR | 2 652 430 | 3/1991 |

* cited by examiner

*Primary Examiner*—Farzana Hossain
(74) *Attorney, Agent, or Firm*—Lerner, David, Littenberg, Krumholz & Mentlik, LLP

(57) ABSTRACT

A broadcast receiver includes a controller that detects a reception log of a receiving unit and that records the reception log in a reception log memory. The reception log includes at least the reception channel, reception start time, and reception end time. Periodically an audience member connects the broadcast receiver to a general-purpose computer. The general-purpose computer transmits the reception log data recorded in the reception log memory with a receiver ID written in a ROM through a telephone line over a communication network, such as the Internet. A person who computes viewing/listening information obtains the reception log data and receiver ID from the communication network and computes viewing/listening information, such as a program rating. Instead of providing the broadcast receiver with the reception log memory and a computer interface, a removable storage unit with a computer interface can also be used.

10 Claims, 6 Drawing Sheets

| CHANNEL | RECEPTION START TIME | | | | RECEPTION END TIME | | | |
|---|---|---|---|---|---|---|---|---|
| | YEAR | MONTH | DATE | TIME | YEAR | MONTH | DATE | TIME |
| 1 | 2000 | 10 | 01 | 08 : 10 | 2000 | 10 | 01 | 10 : 20 |
| 10 | 2000 | 10 | 01 | 10 : 20 | 2000 | 10 | 01 | 11 : 00 |
| 12 | 2000 | 10 | 02 | 12 : 00 | 2000 | 10 | 02 | 14 : 00 |
| 6 | 2000 | 10 | 05 | 13 :00 | 2000 | 10 | 05 | 15 :00 |
| 4 | 2000 | 10 | 06 | 13 :00 | 2000 | 10 | 06 | 13 :30 |

FIG. 5A

| RECEIVER ID | PROGRAM ID |
|---|---|
| 000001 | 000003 |
| 000001 | 000012 |
| 000001 | 000011 |
| 000001 | 000080 |
| 000001 | 000040 |

FIG. 5B

| PROGRAM ID | LABEL |
|---|---|
| 000001 | MUSIC S-1 |
| 000002 | MUSIC S-2 |
| 000003 | MUSIC S-1 |
| 000004 | MUSIC S-1 |
| 000005 | MUSIC S-1 |
| 000006 | TALK S-5 |

FIG. 5C

| PROGRAM ID | PROGRAM RATING (%) |
|---|---|
| 000001 | 10 |
| 000002 | 10.5 |
| 000003 | 11.5 |
| 000004 | 15 |
| 000005 | 18 |
| 000006 | 10 |

BROADCAST RECEIVER AND METHOD AND APPARATUS FOR COMPUTING VIEWING/LISTENING INFORMATION

BACKGROUND OF THE INVENTION

1. Field of the Invention

The present invention relates to broadcast receivers and methods and apparatuses for computing viewing/listening-related information such as so-called audience ratings.

2. Description of the Related Art

When broadcasting to the general public, various methods have been employed to survey program reception states of viewers and/or listeners (recipients) at receivers (receiving terminals). Because the receivers are not provided with transmitting functions, the viewers/listeners (hereinafter referred to as "audience members") are requested to give feedback on their program reception states via postcards, facsimiles, etc. Another example includes a method of installing back-channel transmitting devices on the receivers of some of the audience members and obtaining the program reception states of the receivers through a telephone line.

The method of requesting that the audience members to feedback their program reception states by postcards and facsimiles imposes heavy burden on the audience members, resulting in poor response rate. Even if responses are collected from the audience members, whether or not the audience members have actually seen a particular program depends on the audience members' responses, and the survey result lacks accuracy.

The method of installing the back-channel transmitting devices on the receivers of some of the audience members has a demerit in that it is impossible to install back-channel transmitting devices on small receivers such as portable receivers. Another demerit is that dedicated equipment is required for this method, leading to rising costs. It is therefore impossible to detect the program reception states of a large number of audience.

SUMMARY OF THE INVENTION

Accordingly, it is an object of the present invention to accurately detect program reception states of a large number of audience while reducing the burden on the audience members and the cost and to strongly encourage the production of programs which reflect audience members' preferences.

According to an aspect of the present invention, a broadcast receiver is provided including a receiving unit for selecting a channel and for receiving broadcasting; a controller for controlling channel selection by the receiving unit and for detecting a reception log; a storage unit in which the detected reception log is recorded; and an interface for transmitting the reception log read from the storage unit to an external computer.

According to another aspect of the present invention, a broadcast receiver is provided including a receiving unit for selecting a channel and for receiving broadcasting; a controller for controlling channel selection by the receiving unit and for detecting a reception log; and a mounting section on which a removable storage unit with a computer interface is mounted. By mounting the storage unit on the mounting section, the reception log detected by the controller is recorded in the storage unit. By mounting the storage unit on an external computer, the computer reads the reception log from the storage unit.

According to a further aspect of the present invention, a viewing/listening information computing method is provided including the steps of obtaining a reception log of at least one broadcast receiver and recording the reception log in a database; recording program information concerning a broadcast program in the database; and reading the reception log and the program information from the database and computing viewing/listening information which is information concerning viewing and/or listening.

According to yet another aspect of the present invention, a viewing/listening information computing apparatus is provided including a reception state management unit for obtaining a reception log of at least one broadcast receiver; a database in which the obtained reception log and program information concerning a broadcast program are recorded; and a viewing/listening information management unit for computing viewing/listening information which is information concerning viewing and/or listening based on the reception log and the program information read from the database.

Accordingly, a broadcast receiver is only required to contain a storage unit for storing a reception log; an interface for transmitting the reception log to an external computer (instead of the storage unit and the interface, the broadcast receiver can be provided with a mounting section on which a removable storage unit with a computer interface is mounted); and a processing program for detecting the reception log of a receiving unit and for recording the reception log in the storage unit or in the storage unit mounted on the broadcast receiver. Thus, the necessity for expensive equipment is eliminated. An audience member is only required to periodically transmit the reception log recorded in the storage unit of the broadcast receiver or in the removable storage unit mounted on the broadcast receiver over a communication network such as the Internet using an external computer such as a general-purpose (household) computer. As a result, the burden on the audience member is reduced.

Since a controller of the broadcast receiver detects and records the reception log of the receiving unit, the reception log becomes accurate. Currently, computers such as personal computers have been widely used. It is thus possible to obtain reception logs of a large number of broadcast receivers and accurately detect program reception states of a large number of audience. The production of programs which reflect audience members' preferences can be strongly encouraged.

According to the present invention, it is possible to accurately detect program reception states of a large number of audience using a method which can be implemented at a small cost with minimal burden on the audience members. Thus the production of programs which reflect audience members' preferences can be strongly encouraged.

BRIEF DESCRIPTION OF THE DRAWINGS

FIGS. 5A to 5C are tables showing examples of the recorded contents of databases in an viewing/listening information computing apparatus;

DESCRIPTION OF THE PREFERRED EMBODIMENTS

Figure 1:
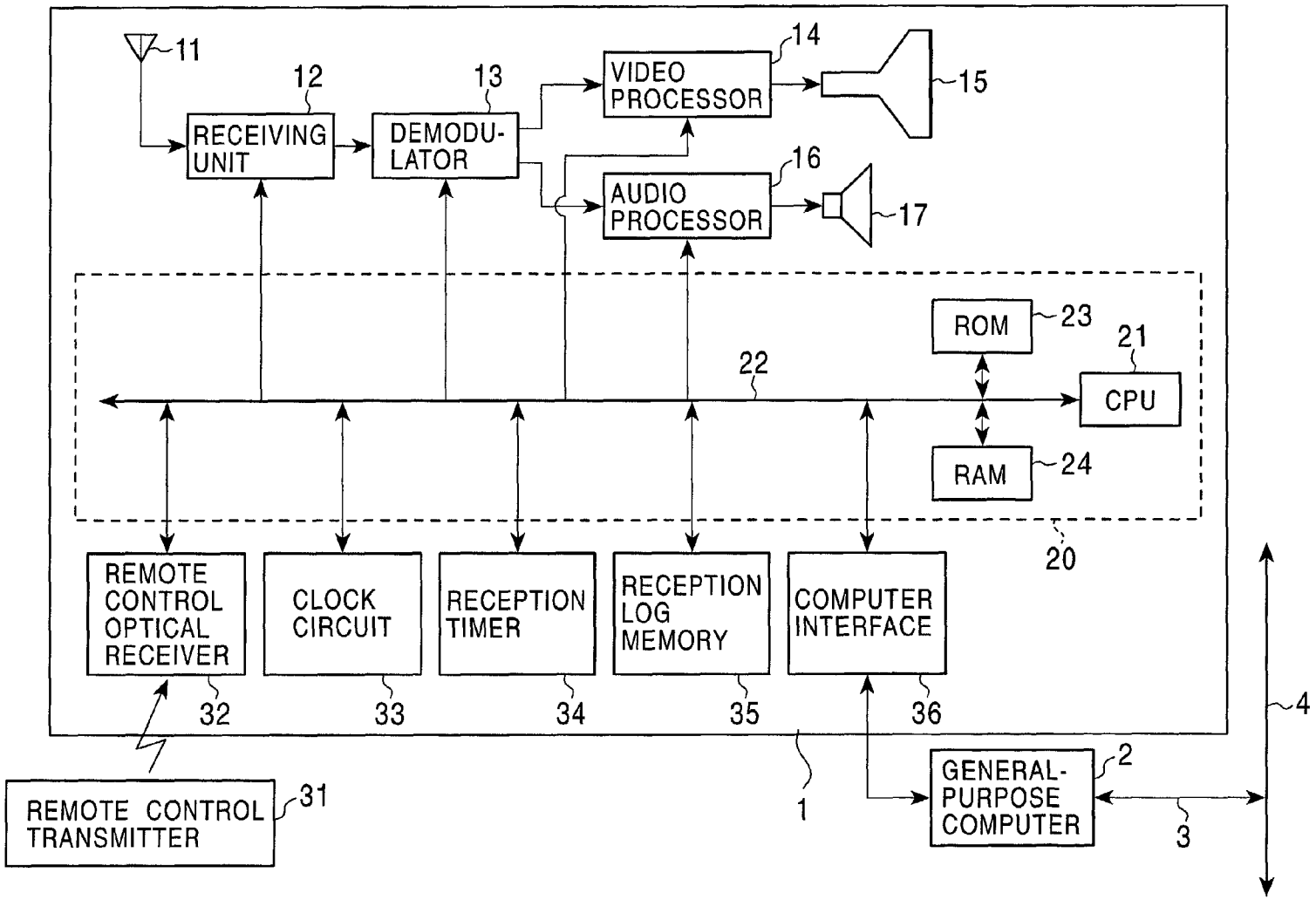
FIG. 1 is a block diagram showing an example of a broadcast receiver according to an embodiment of the present invention.
Figures 2, 3:
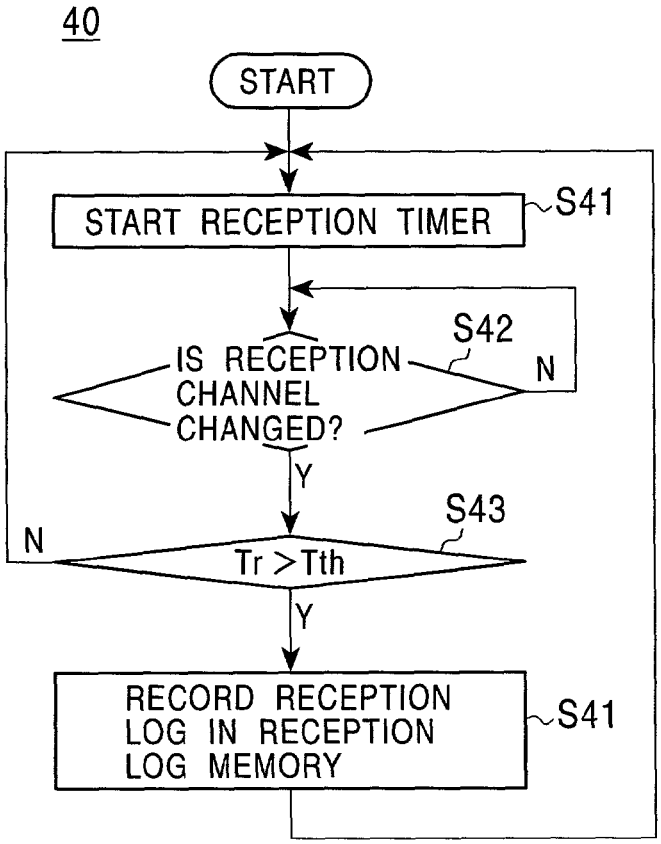
FIG. 2 is a flowchart showing an example of a reception log recording routine.
FIG. 3 is a table showing an example of reception log data.

Embodiment of Broadcast Receiver (FIGS. 1 to 3)

FIG. 1 shows an example of a broadcast receiver according to an embodiment of the present invention. The broadcast receiver receives terrestrial analog television broadcasting.

In a receiver 1 in this example, a receiving unit 12 selects a channel and receives airwave signals from an antenna 11. The received signals are demodulated by a demodulator 13. The demodulator 13 generates video signals and audio signals. The video signals are processed by a video processor 14 and output to a display device 15 such as a cathode-ray tube (CRT) display or liquid crystal display (LCD). The audio signals are processed by an audio processor 16 and output to an audio output device 17 such as a loudspeaker or headphone.

The receiver 1 includes a controller 20 for controlling each portion of the receiver 1 such as channel selection by the receiving unit 12. The controller 20 contains a CPU (central processing unit) 21. A ROM (read only memory) 23 and a RAM (random-access memory) 24 are connected to a bus 22. The ROM has written therein processing programs such as channel selection and reception log recording (described below) to be performed by the CPU 21, and fixed data such as a receiver ID (identification information) (described below). The RAM 24 functions as a work area for the CPU 21.

Also, a remote control optical receiver 32 for receiving infrared remote control signals from a remote control transmitter 31, a clock circuit 33 for measuring time, a reception timer 34 for detecting a reception log, a reception log memory 35 in which a reception log is recorded, and a computer interface 36 for transmitting the reception log recorded in the reception log memory 35 to a general-purpose (household) computer 2 are connected to the bus 22.

For example, the reception log memory 35 can be nonvolatile memory (the recorded contents are maintained in a no-power state) or a memory whose recorded contents are maintained by a backup power supply. Examples of the computer interface 36 include wireless/wired computer interfaces such as USB (Universal Serial Bus) and Bluetooth (one type of short-distance wireless communication specification).

A communication network 4 such as the Internet is connected to the general-purpose computer 2 through a telephone line 3.

When an audience member selects a channel using the remote control transmitter 31, a control signal based on the user operation is supplied through the remote control optical receiver 32 to the bus 22, and the controller 20 (CPU 21) controls the channel selection by the receiving unit 12.

When the audience member turns ON the receiver 1, the receiving unit 12 under the control of the controller 20 selects and receives a so-called last channel which is a channel received at the same time the receiver 1 was turned OFF prior to turning ON the receiver 1 or to a predetermined channel.

When reception starts in this manner, the controller 20 performs a reception log recording routine as shown in FIG. 2 to detect a reception log of the receiving unit 12 and record the reception log in the reception log memory 35.

Specifically, when reception starts, in step S41, a reception log recording routine 40 (hereinafter referred to as a "routine 40") starts the reception timer 34. In step S42, the routine 40 determines whether or not the reception channel has been changed by the audience member.

If the reception channel has been changed, the routine 40 determines in step S43 whether time Tr, which is measured by the reception timer 34 and which is the length of the period of continuous reception of the same channel, is longer than a predetermined threshold time period Tth. If $Tr \leqq Tth$, that is, if the time period Tr of continuous reception of the same channel is less than or equal to the threshold time period Tth, reception until that moment is not recorded as a reception log. The routine 40 returns from step S43 to step S41 and again starts the reception timer 34.

In contrast, if $Tr > Tth$, that is, if the time period Tr of continuous reception of the same channel is longer than the threshold time period Tth, the routine 40 proceeds from step S43 to step S44 and records the reception as the reception log in the reception log memory 35. The routine 40 returns to step S41 and again starts the reception timer 34.

Reception in which the audience member switches between the channels in a short time period such as a few seconds or ten or more seconds in order to find a desired program is not recorded as a reception log. Only reception in which the receiving unit 12 continuously receives the same channel for one minute or longer is recorded as a reception log in the reception log memory 35.

Similar to a case in which the reception channel is changed, when the receiver 1 is turned OFF, the controller 20 determines in step 43 whether $Tr > Tth$. If $Tr \leqq Tth$, reception until that moment is not recorded as the reception log, and the reception log recording process is terminated. If $Tr > Tth$, the routine 40 proceeds to step S44 and records reception until that moment as the reception log in the reception log memory 35. Subsequently, the reception log recording process is terminated.

Referring to FIG. 3, reception log data which includes at least the received channel and reception period information detected by the clock circuit 33 is recorded in the reception log memory 35. The reception period information includes a pair of a reception start time and a reception end time or a pair of the reception start time and a reception duration.

The audience member is not required to perform special processing to record the reception log. Periodically, for example, once a week, the audience member connects the receiver 1 to the general-purpose computer 2. Using the general-purpose computer 2, the audience member transmits the reception log data recorded in the reception log memory 35, together with the receiver ID written in the ROM 23, through the telephone line 3 over the communication network 4.

In this case, the general-purpose computer 2 is operated to transmit a transmission request command therefrom to the CPU 21 through the computer interface 36. In response, the CPU 21 reads the reception log data from the reception record memory 35 and the receiver ID from the ROM 23 and transmits the read reception data and received ID to the general-purpose computer 2 through the computer interface 36.

The receiver ID is set for each receiver by the manufacturer of the receiver 1. When a plurality of manufacturers manufacture receivers, a plurality of high-order bits of a receiver ID are used as identification code for each manufacturer so that receiver IDs do not overlap one another.

In the example shown in FIG. 1, the receiver 1 is provided with the reception log memory 35 and the computer interface 36. Alternatively, for example, the receiver 1 can be formed so that a removable recording unit (recording medium) with a computer interface, such as Memorystick (registered trademark) or Smartmedia (registered trademark) can be installed on the receiver 1, and a system can be configured as follows: When receiving a broadcast, the audience member mounts the recording unit on the receiver 1, thereby allowing the reception log data to be recorded in the recording unit. When transmitting the reception log, the audience member removes the recording unit form the receiver 1 and inserts the recording unit into the general-purpose computer 2, thereby allowing the general-purpose computer 2 to read the reception log data from the recording unit and transmit the reception log data over the communication network 4.

In this case, every time the reception log data is recorded in the recording unit which is mounted on the receiver 1, the receiver 1 can be configured to record the receiver ID in the recording unit under the control of the controller 20. Alternatively, the receiver ID (storage unit ID) can be written in advance in the recording unit. Alternatively, when a plurality of audience members receive broadcasts using a single receiver while the audience members have individual recording units, a system can be configured as follows. Each audience ID can be written in advance in the recording unit. When transmitting the reception log, the general-purpose computer 2 is used to read the reception log data from the recording unit, together with the receiver ID or the audience ID. The read data are transmitted over the communication network 4. If each audience member has a recording unit wherein his/her ID is written, the audience member can record reception log data by mounting the recording unit on a household receiver when the audience member is at home or on a portable or in-vehicle receiver during travel to or from school or work. As a result, individual reception log data for audience members can be recorded independently of receivers.

According to the above-described broadcast receiver, the receiver 1 is only required to contain the reception log memory 35; the computer interface 36 or a mounting section on which a removable recording unit with a computer interface is mounted; and a processing program for detecting a reception log of the receiving unit 12 and recording the reception log in the reception log memory 35 or the recording unit mounted on the receiver 1. The necessity for expensive equipment is thus eliminated. Also, the audience member is only required to periodically transmit the reception log recorded in the reception log memory 35 or the recording unit mounted on the receiver 1 over the communication network 4 using the general-purpose computer 2. Thus, the burden on the audience member is reduced.

Figure 4:
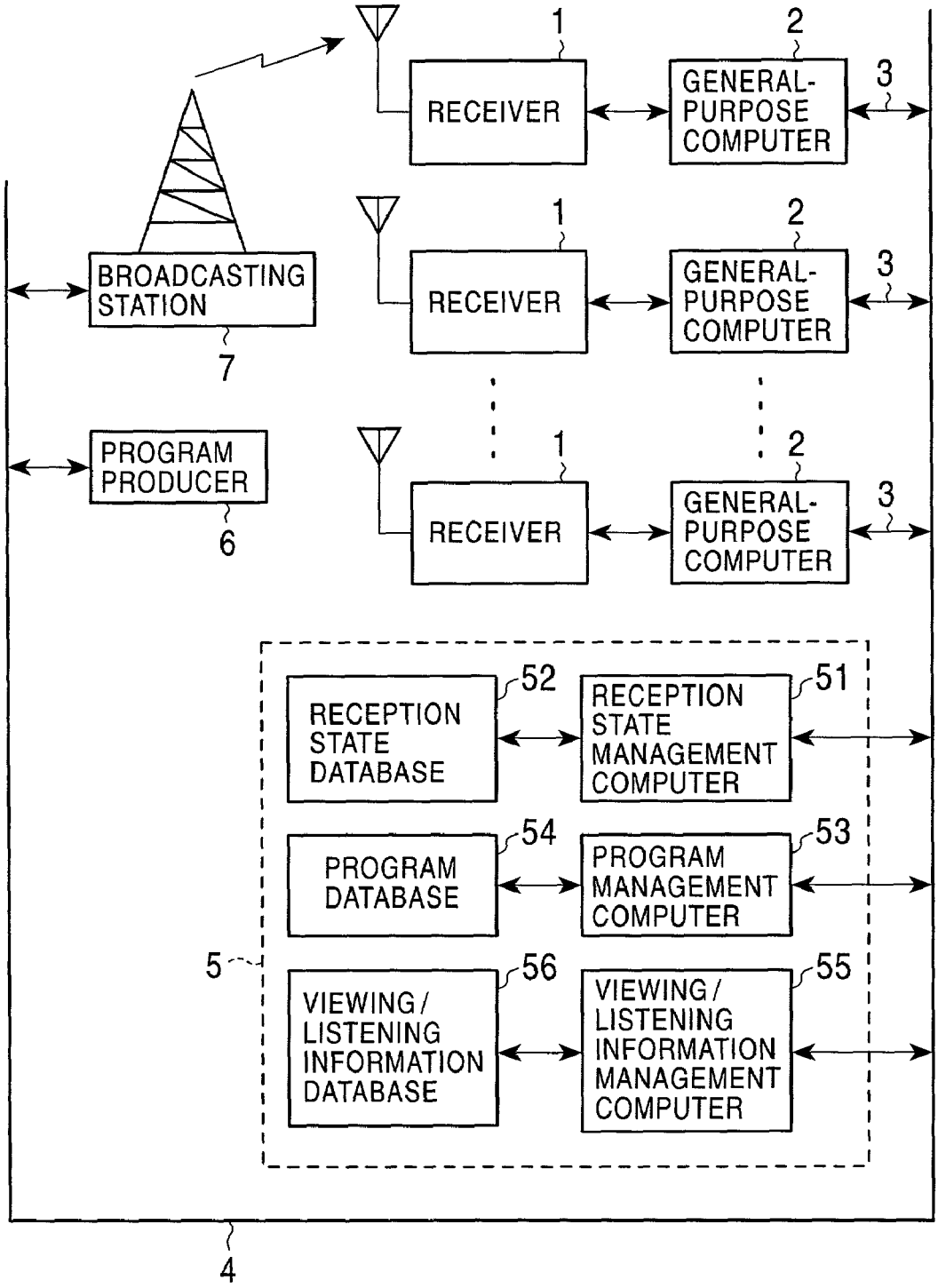
FIG. 4 is a block diagram showing an example of a system which executes a viewing/listening information computing method according to another embodiment of the present invention.
Figure 6:
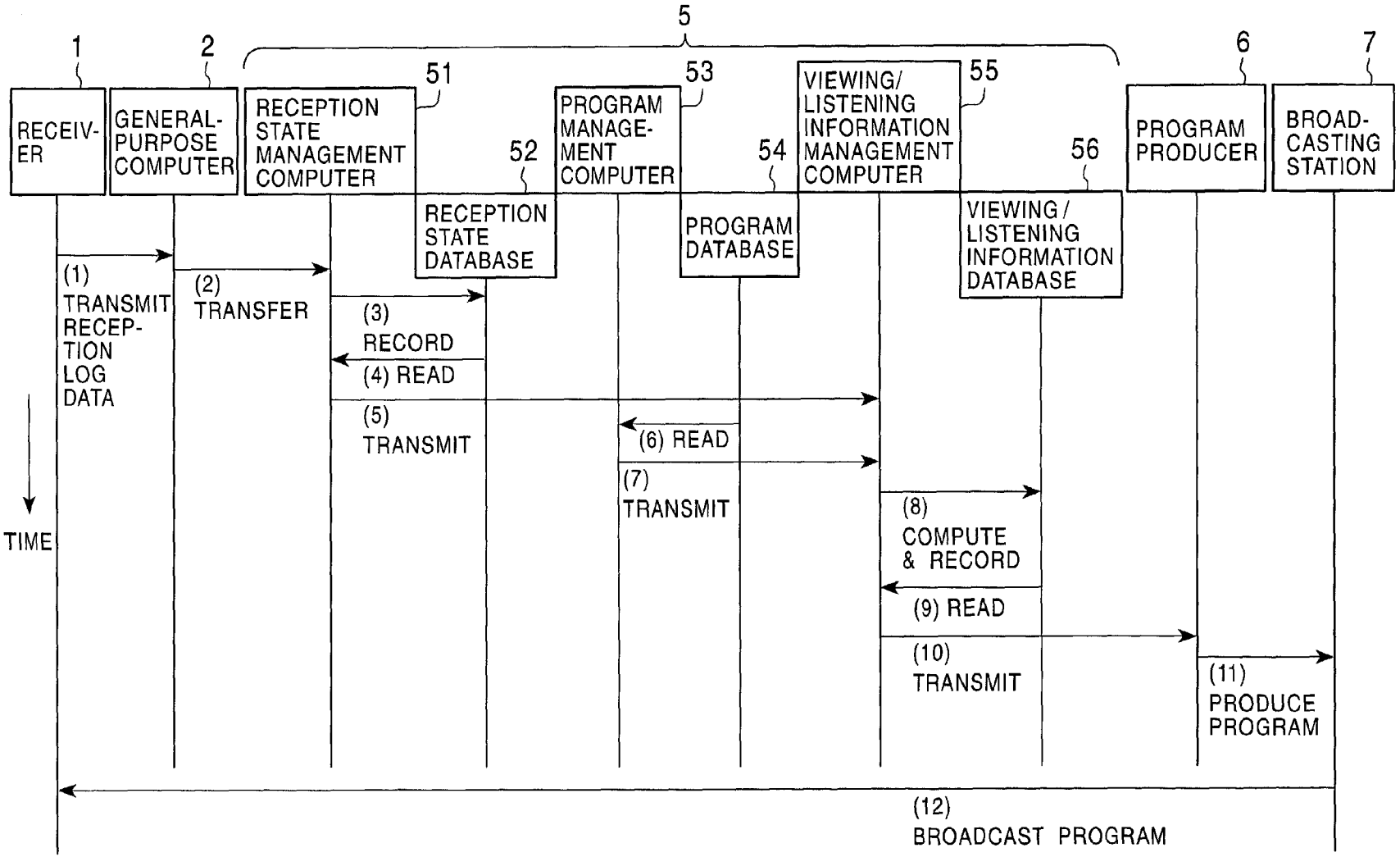
FIG. 6 is a flowchart showing an example of the procedure of the viewing/listening information computing method.

Embodiments of Method and Apparatus for Computing Viewing/Listening Information (FIGS. 4 to 6)

FIG. 4 shows an example of a system for computing viewing/listening information (information related to viewing and/or listening) using the above-described broadcast receiver.

In this system, as described above, data which indicates the reception log of each receiver 1 is transmitted, together with the receiver ID (or audience ID), through the telephone line 3 over the network 4 using the general-purpose computer 2. The communication network 4 includes, for example, the Internet. Accordingly, the necessity for dedicated equipment can be eliminated.

A person who computes viewing/listening information uses a viewing/listening information computing apparatus 5 to obtain the reception log data and the receiver ID (or audience ID) via the communication network 4. In order to collect reception logs from more audience members, the person who computes viewing/listening information can pay audience members who have transmitted the reception log data.

In the example shown in FIG. 4, the person who computes viewing/listening information receives program information (information concerning broadcast programs) from a broadcasting station 7 and, as described below, supplies computed viewing/listening information to a program producer 6. The program producer 6 determines audience members' preferences based on the viewing/listening information given, produces a program which reflects the audience members' preferences, and supplies the program to the broadcasting station 7. The same applies to a case in which the program producer 6 independently computes viewing/listening information; to a case in which the broadcasting station 7 independently produces a program; and to a case in which the broadcasting station 7 both independently computes viewing/listening information and produces a program.

The viewing/listening information computing apparatus 5 functionally contains a reception state management computer 51, a reception state database 52, a program management computer 53, a program database 54, a viewing/listening information management computer 55, and a viewing/listening information database 56, all of which are connected to the communication network 4.

The reception log data and receiver ID (or audience ID) transmitted over the communication network 4 are received by the viewing/listening information computing apparatus 5 using the reception state management computer 51 and the received data is recorded in the reception state database 52.

Prior to transmitting the reception log data over the communication network 4, for example, program information is transmitted from the broadcasting station 7 over the communication network 4 immediately after each program is broadcast. The program information is received by the viewing/listening information computing apparatus 5 using the program management computer 53, and the received program information is recorded in the program database 54.

The program information includes at least a program ID, program broadcast time (a pair of broadcast start time and broadcast end time or a pair of broadcast start time and broadcast duration), program broadcasting channel, and program label. The label indicates the title and the type of a program. For a musical show, the title of a song and artist (performer or singer) are indicated. A broadcasting station classifies programs into categories. Referring to FIG. 5B, the label "music S-1" or "music S-2" indicates that it is a musical show; and the label "talk S-5" indicates that it is a talk show.

When recording the reception log data and the receiver ID (or audience ID) in the reception state database 52, a program ID of a received program indicated by the reception log data is extracted from the program information which has already been recorded in the program database 54. Referring to FIG. 5A, the program ID is associated with the receiver ID (or audience ID), and the program ID and the receiver ID (or audience ID) are recorded in the reception state database 52.

After the program information is recorded in the program database 54 and the reception log data is recorded in the reception state database 52, the program management computer 53 and the reception state management computer 51 read the program information and the reception log data from the program database 54 and the reception state database 52, respectively, and transmit the read information to the viewing/listening information management computer 55.

The viewing/listening information management computer 55 computes viewing/listening information such as a program rating (described below) based on the transmitted program information and the reception log data. As shown in FIG. 5C, the viewing/listening information management computer 55 associates the viewing/listening information with the program ID and records the information in the viewing/listening information database 56.

The viewing/listening information management computer 55 reads the viewing/listening information from the viewing/ listening information database 56, transmits the viewing/listening information over the communication network 4, and supplies the viewing/listening information to the program producer 6. The program producer 6 determines audience members' preferences based on the supplied viewing/listening information, produces a program which reflects audience members' preferences, and supplies the program to the broadcasting station 7.

Referring FIG. 6, the above-described process will now be described. Given the program information recorded in the program database 54, the receiver 1 transmits the reception log data to the general-purpose computer 2. The general-purpose computer 2 in turn transfers the reception log data to the reception state management computer 51. The reception log data is recorded in the reception state database 52.

When the reception log data for each receiver 1 is recorded in the reception state database 52, the reception state management computer 51 reads the reception log data from the reception state database 52 and transmits the reception log data to the viewing/listening information management computer 55. The program management computer 53 reads the program information from the program database 54 and transmits the program information to the viewing/listening information management computer 55. Reading and transmission of the reception log data can be performed prior to reading and transmission of the program information and vice versa.

The viewing/listening information management computer 55 computes viewing/listening information and records the viewing/listening information in the viewing/listening information database 56. Subsequently, the viewing/listening information management computer 55 reads the viewing/listening information from the viewing/listening information database 56 and transmits the read viewing/listening information to the program producer 6.

Based on the viewing/listening information, the program producer 6 can determine the audience members' preferences. In this case, the preferences represent a classification arranged by the program producer 6 for viewing and/or listening (reception) by audience members and conforms to an arbitrary category standard. For example, the label can be used to indicate a preference. Alternatively, the label coupled with viewing/listening (reception) time can be used to indicate a preference.

The program producer 6 produces a program based on the preferences and supplies the program to the broadcasting station 7. The broadcasting station 7 broadcasts the program to the receiver 1 (audience member).

The above description illustrates the functions of the viewing/listening information computing apparatus 5. Physically, the viewing/listening information computing apparatus 5 can be implemented using a single computer.

As described above, the same applies to a case in which the program producer 6 independently computes viewing/listening information; to a case in which the broadcasting station 7 independently produces a program; and to a case in which the broadcasting station 7 both independently computes viewing/listening information and produces a program.

According to the above-described viewing/listening information computing method, the necessity for expensive equipment can be eliminated, and the burden on audience members is reduced. Because accurate reception logs of a large number of broadcast receivers can be collected, it is possible to accurately detect program reception states of a large number of audience. Thus, the production of programs which reflect audience members' preferences can be strongly encouraged.

Figure 7:
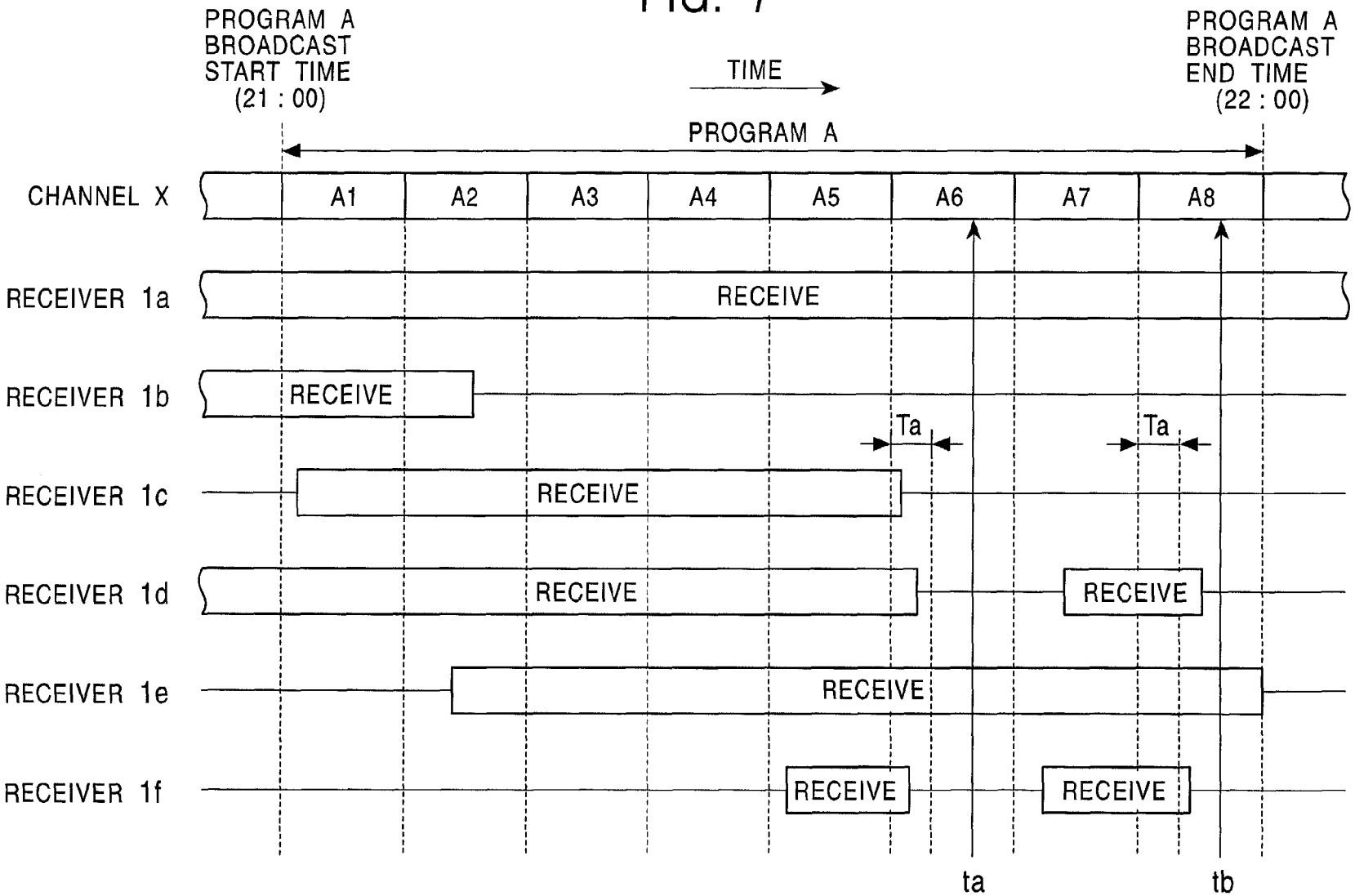
FIG. 7 illustrates various pieces of viewing/listening information to be computed.

Example of Viewing/Listening Information (FIG. 7)

Using the above-described viewing/listening information computing method, the following viewing/listening information is computed.

Referring to FIG. 7, a case in which a certain program A containing portions A1 to A8 (described below) has been broadcast on a certain channel X for an hour from 21:00 to 22:00 on a certain day is used for explanation. A receiver 1*a* has received the channel X from time prior to the broadcast start time of the program A to time subsequent to the broadcast end time of the program A. A receiver 1*b* has received the channel X from the time prior to the broadcast start time of the program A to the midstream of the portion A2. A receiver 1*c* has received the channel X from time immediately after the broadcast start time of the program A to the beginning of the portion A6. A receiver 1*d* has received the channel X from time prior to the broadcast start time of the program A to the midstream of the portion A6 and again has received the channel X from the midstream of the portion A7 to the midstream of the portion A8. A receiver 1*e* has received the channel X from the midstream of the portion A2 to the broadcast end time of the program A. A receiver 1*f* has received the channel X from the beginning of the portion A5 to the beginning of the portion A6 and again has received the channel X from the midstream of the portion A7 to the midstream of the portion A8.

The portions A1 to A8 are unit portions separated depending on the label of the program A. For example, if the program A is a musical show, different singers perform in the portions A1 to A8. If the program A is a talk show, there are different guests in the portions A1 to A8.

In this case, receivers other than the receivers 1*a* to If have not received the channel X (program A) while the program A is being aired. This fact is indicated by the corresponding reception logs.

The total number of receivers which have transmitted reception logs for a period including the broadcast time of the program A is represented by Mt. From among Mt, the number of receivers which have received the channel X (program A) while the program A is being broadcast is represented by Mx; the number of receivers which have received a channel(s) other than the channel X is represented by My; and the number of receivers which have received neither the channel X nor the other channels is represented by Mz. Receivers which have received both the channel X and the other channel(s) while the program A is being broadcast are included in Mx, not in My. This gives the following equation: Mt=Mx+My+Mz. If Mx+My=Ms, then Ms indicates the total number of receivers which have received any channel(s) while the program A is being broadcast.

In this example, for the program A, two ratings, namely, a program formal rating Rt defined by equation (1) and a program substantial rating Rs defined by equation (2), are computed:

$$Rt=(Mx/Mt)\times 100\% \quad (1)$$

$$Rs=(Mx/Ms)\times 100\% \quad (2)$$

The difference between the program formal rating Rt and the program substantial rating Rs is whether the denominator is Mt or Ms. Since Ms≦Mt, then Rs≧Rt.

In the case shown in FIG. 7, Mx=6 (six receivers 1*a* to 1*f*). For example, if Mt=50 and Ms=40, the program formal rating Rt for the program A is 12%, and the program substantial rating Rs for the program A is 15%.

If necessary, either the program formal rating Rt or the program substantial rating Rs may be computed as a program rating R.

In this example, an instantaneous rating for the program A at arbitrary time, such as time ta or time tb in FIG. 7, is computed.

The total number of receivers which have transmitted the reception logs for a period including that time is represented by Nt. From among Nt, the number of receivers which have received the channel X (program A) at that time is represented by Nx; the number of receivers which have received the other channels is represented by Ny; and the number of channels which have received neither the channel X nor the other channels is represented by Nz. This gives the following equation: Nt=Nx+Ny+Nz. If Nx+Ny=Ns, then Ns indicates the total number of receivers which have received any channel(s).

For the program A, two instantaneous ratings, namely, an instantaneous formal rating Pt defined by equation (3) and an instantaneous substantial rating Ps defined by equation (4) are computed:

$$Pt=(Nx/Nt)\times 100\% \quad (3)$$

$$Ps=(Nx/Ns)\times 100\% \quad (4)$$

The difference between the instantaneous formal rating Pt and the instantaneous substantial rating Ps is whether the denominator is Nt or Ns. Since Ns≦Nt, then Ps≧Pt.

In the case shown in FIG. 7, at both times ta and tb, Nx=2 (two receivers 1*a* and 1*e*). For example, if Nt=50 and Ns=40 at both times ta and tb, the instantaneous formal ratings Pt for the program A at times ta and tb are 4%, and the instantaneous substantial ratings Ps are 5%.

If necessary, either the instantaneous substantial rating Pt or the instantaneous substantial rating Ps may be computed as an instantaneous rating P.

In this example, every unit time such as every second or every minute starting from the broadcast start time to the broadcast end time of the program A, an average of instantaneous formal ratings Pt and an average of instantaneous substantial ratings Ps over the entire broadcast time period of the program A (which in this case is one hour) are computed as a program average formal rating Qt and a program average substantial rating Qs, respectively, for the program A.

If necessary, either the program average formal rating Qt or the program average substantial rating Qs may be computed as a program average rating Q.

In this example, every unit portion (portions A1 to A8 in the case shown in FIG. 7), a program unit formal rating rt and a program unit substantial rating rs are computed based on the program formal rating Rt and the program substantial rating Rs. In other words, in the definitions of the program formal rating Rt and the program substantial rating Rs, the program A is replaced by each unit portion. Also, a program unit average formal rating qt and a program unit average substantial rating qs are computed based on the program average formal rating Qt and the program average substantial rating Qs. In other words, in the definitions of the program average formal rating Qt and the program average substantial rating Qs, the program A is replaced by each unit portion.

If necessary, either the program unit formal rating rt or the program unit substantial rating rs may be computed as a program unit rating r. Also, either the program unit average formal rating qt and the program unit average substantial rating qs maybe computed as a program unit average rating q.

Accordingly, audience members' preferences can be detected for every unit portion of the program A.

In the case shown in FIG. 7, it is assumed that Mt=50 and Ms=40 in the portions A1 to A8. The program unit formal rating rt and the program unit substantial rating rs for each portion are computed in the following manner. For the portion A1, since Mx=4 (four receivers 1*a* to 1*d*), then rt=8% and rs=10%. For the portion A2, since Mx=5 (five receivers 1*a* to 1*e*), then rt=10% and rs=12.5%. For the portion A6, since Mx=5 (five receivers 1*a*, 1*c*, 1*d*, 1*e*, and 1*f*), then rt=10% and rs=12.5%. For the portion A8, since Mx=4 (four receivers 1*a*, 1*d*, 1*e*, and 1*f*), then rt=8% and rs=10%.

In this example, the ratio of the number of receivers which have stopped receiving the program A within a predetermined time period since the program start time of a certain unit time (hereinafter referred to as number "k") to the number of receivers which have received the program A at the broadcast start time of the unit time (hereinafter referred to as number "K") is computed as a program unit non-viewing/non-listening ratio for the unit time of the program A:

$$G=(k/K)\times 100\% \quad (5)$$

A predetermined time period Ta is preset in accordance with the entire time period of the corresponding unit portion so that Ta is sufficiently shorter than the entire time period of the unit portion, that is, Ta is ¼ or ⅓ of the entire time period of the unit portion. Instead, Ta can be fixed.

In the case shown in FIG. 7, for the portion A6, K=5 (five receivers 1*a*, 1*c*, 1*d*, 1*e*, and 1*f*) and k=3 (three receivers 1*c*, 1*d*, and 1*f*). Thus, the program unit non-viewing/non-listening rating G is 60%. For the portion A8, K=4 (four receivers 1*a*, 1*d*, 1*e*, and 1*f*) and k=0 (none of the receivers 1*a*, 1*d*, 1*e*, and 1*f* has stopped receiving the program A during the predetermined time period Ta from the broadcast start time of the portion A8). Thus, the program unit non-viewing/non-listening ratio G is 0%.

When the label of the program changes, that is, when a different singer or guest appears, an audience member who has been receiving the program up to that moment may change the channel or turn off the receiver, that is, stop receiving the program. In such a case, it is very likely that the audience member does not like the new contents of the program.

Computation of the program rating R (program formal rating Rt or program substantial rating Rs) or the program average rating Q (program average formal rating Qt or program average substantial rating Qs) which can be regarded as the degree of active or passive interest in the entire program, the program unit rating r (program unit formal rating rt or program unit substantial rating rs) or the program unit average rating q (program unit average formal rating qt or program unit average substantial rating qs) which can be regarded as the degree of active or passive interest in the program unit, and the program unit non-viewing/non-listening rating G which can be regarded as the degree of active avoidance of the program unit allows audience members' preferences to be precisely detected in detail for several situations.

In the foregoing example, viewing/listening information is computed based on the number of receivers. As described above, when each audience member possesses a removable storage unit with a computer interface, various ratings and the non-viewing/non-listening rating defined by equations (1) to (5) are defined by replacing the number of receivers with the number of storage units. In this way, viewing/listening information is detected based on the number of storage units.

Other Embodiments

Although the foregoing example illustrates a case of terrestrial analog television broadcasting being received, the present invention can be applied to receiving BS (broadcasting satellite) digital broadcasting, CS (communications satellite) broadcasting, DAB (digital audio broadcasting or the Eureka 147 standard in Europe), and general digital audio broadcasting.

In digital broadcasting, the number and title of a program are broadcast. This enables a receiver for receiving digital broadcasting to detect and record the number and title of a selectively received program as part of a reception log.

In digital broadcasting, information such as the type or category of a program, the title of a piece of music performed in the program, and the name of an artist performing in the program can be broadcast. Accordingly, the digital broadcast receiver can detect and record these pieces of information as part of the reception log.

What is claimed is:

1. A viewing and listening information computing method, comprising the steps of:

obtaining a reception log and a receiver ID of at least one broadcast receiver and recording the reception log and the receiver ID in a database;

recording program information concerning a broadcast program in the database, the program information including a program label indicating the type of program and unit portions of the program separated based on different content specific to the type of program;

reading the reception log, the receiver ID, and the program information from the database and computing viewing and listening information concerning viewing and listening, wherein the viewing and listening information includes viewer preferences for each unit portion of the program, wherein computing the viewing and listening information includes computing a rating for each unit portion of the program using a total number of receivers that received the unit portion of the program, and wherein a reception is recorded in the reception log of said at least one broadcast receiver only when said at least one broadcast receiver continuously receives a channel and/or a program for a predetermined period and a reception is not recorded in the reception log of said at least one broadcast receiver when said least one broadcast receiver does not continuously receive a channel and/or a program for at least the predetermined period.

2. The viewing and listening information computing method according to claim 1, wherein the reception log includes one of a channel received by the broadcast receiver and program identification information and reception period information; and the viewing and listening information computed includes an audience rating for one of a predetermined channel and a program.

3. The viewing and listening information computing method according to claim 1, wherein the reception log includes one of a channel received by the broadcast receiver and program identification information and reception period information; and the viewing and listening information computed comprises a non-viewing and non-listening rating for one of a predetermined channel and a program.

4. A viewing and listening information computing apparatus, comprising:

reception state management means for obtaining a reception log and a receiver ID of at least one broadcast receiver;

a database in which the obtained reception log, receiver ID, and program information concerning a broadcast program are recorded, the program information including a program label indicating a type of program and unit portions of the program separated based on different content specific to the type of program;

viewing and listening information management means for computing viewing and listening information which is information concerning viewing and listening based on the reception log, the receiver ID, and the program information read from the database, wherein the viewing and listening information includes viewer preferences for each unit portion of the program, wherein the viewing and listening information includes a rating for each unit portion of the program computed using a total number of receivers that received the unit portion of the program, and wherein a reception is recorded in the reception log of said at least one broadcast receiver only when said at least one broadcast receiver continuously receives a channel and/or a program for a predetermined period and a reception is not recorded in the reception log of said at least one broadcast receiver when said least one broadcast receiver does not continuously receive a channel and/or a program for at least the predetermined period.

5. The viewing and listening information computing apparatus according to claim 4, wherein:

the reception log includes one of a channel received by the broadcast receiver and program identification information and reception period information; and the viewing and listening information computed includes an audience rating for one of a predetermined channel and a program.

6. The viewing and listening information computing apparatus according to claim 4, wherein:

the reception log includes one of a channel received by the broadcast receiver and program identification information and reception period information; and the viewing and listening information computed includes a non-viewing and non-listening rating for one of a predetermined channel and a program.

7. A system comprising:

a receiver, including:

a receiving unit for selecting a channel and for receiving a broadcast;

a controller for controlling channel selection and for detecting a reception log; and a memory for storing the reception log and a receiver ID; a viewing and listening information computing apparatus communicatively coupled to the receiver, the viewing and listening information computing apparatus including:

a reception state management computer for obtaining a reception log and the receiver ID from the receiver;

a database in which the obtained reception log and receiver ID are recorded;

a program management computer for receiving program information including a program ID, a program label indicating a type of program, and unit portions of a program separated based on different content specific to the type of program; and a viewing and listening information management computer for computing viewing and listening information including a rating concerning viewing and listening for each unit portion of the program based on the reception log, the receiver ID, and the program information, and for transmitting the computed viewing and listening information to a program producer;

wherein the rating is computed using a total number of receivers that received the unit portion of the program.

8. The system of claim 7, wherein the receiver and the viewing and listening information computing apparatus are coupled via a communication network including the Internet.

9. The system of claim 7, wherein the receiver and the viewing and listening information computing apparatus are coupled via an external computer.

10. A method of obtaining viewing and listening information, comprising:

selecting a channel and receiving a broadcast via a receiving unit having a receiver ID; detecting a reception log;

storing the reception log and the receiver ID in a database;

obtaining, using a program management computer, program information including a program ID, a program label indicating a type of program, and unit portions of a program separated based on different content specific to the type of program;

computing, using a viewing and listening management computer, viewing and listening information concerning viewing and listening for each unit portion of the program based on the reception log, the receiver ID, and the program information; and transmitting the computed viewing and listening information to a program producer;

wherein the viewing and listening information includes a rating for each unit portion of the program computed using a total number of receivers that received the unit portion of the program.

* * * * *